United States Patent [19]

Damm

[11] 4,046,258

[45] Sept. 6, 1977

[54] METHOD AND APPARATUS FOR MEASURING THE ECCENTRICITY OF CONTAINERS

[75] Inventor: David A. Damm, Swanton, Ohio

[73] Assignee: Owens-Illinois, Inc., Toledo, Ohio

[21] Appl. No.: 701,771

[22] Filed: July 2, 1976

[51] Int. Cl.[2] ..... B07C 5/34

[52] U.S. Cl. ..... 209/111.5; 324/58.5 A

[58] Field of Search ..... 209/81 R, 80, 88, 111.5; 324/71 R, 149, 58.5 B, 58.5 R, 58.5 A

[56] References Cited

U.S. PATENT DOCUMENTS

| | | | |
|---|---|---|---|
| 3,379,306 | 4/1968 | Mathias et al. | 209/111.5 |
| 3,708,064 | 1/1973 | Schepler | 209/111.5 |
| 3,710,938 | 1/1973 | Scherf | 209/111.5 |
| 3,776,380 | 12/1973 | Damm | 209/111.5 |
| 3,780,859 | 12/1973 | Scherf | 209/111.5 |

*Primary Examiner*—Allen N. Knowles
*Attorney, Agent, or Firm*—D. T. Innis; E. J. Holler

[57] ABSTRACT

A method and apparatus for inspecting glass containers is described in which a high frequency field is produced at an inspection station. The high frequency signal, which may be a radio frequency signal, is fed to the antenna of a probe centrally positioned relative to the antenna and coaxial therewith. The probe, as a unit, is supported adjacent the container to be inspected and the container is rotated relative to the probe. The manner of mounting the probe relative to the bottle permits the probe to move closer or further away from the container wall, depending upon the out-of-roundness of the container and the radio frequency signal is picked up by the probe with the signal level depending upon the relative position of the probe and the wall of the container. This varying detection output is compared with a steady state detection output to derive a signal which is proportional to the relative position of the probe and the container wall. The signal is compared with a reject reference signal to indicate a non-acceptable container and may cause rejection of the container.

8 Claims, 4 Drawing Figures

METHOD AND APPARATUS FOR MEASURING THE ECCENTRICITY OF CONTAINERS

BACKGROUND OF THE INVENTION

The present invention is particularly useful in the automatic inspection of the "out-of-round" characteristics of glass containers. A radio frequency field is established in close proximity to a limited surface area of the container and the change in the field strength due to the position of a dielectric material in the field is measured. This measurement is preferably made by positioning a probe in the same plane as the field and centrally of the established field so that the field will pass through the air gap between the container or dielectric member being gauged and the front of the probe. The induced voltage at the probe will be an indication of the field strength due to the relative spacing of the probe and dielectric member.

It is desirable to segregate glass containers having predetermined deviations in the "out-of-round" dimension since such containers may exceed the acceptable physical size tolerances now being imposed by high speed filling, labelling and capping apparatus, and thereby create jam-ups or other undesirable down-time in the customer's plant.

The use of a high frequency field in automatic inspection has been the subject of recent patents assigned to the assignee of the present case, these patents being U.S. Pat. No. 3,379,306 issued Apr. 23, 1968; U.S. Pat. No. 3,393,799 issued July 23, 1968 and U.S. Pat. No. 3,708,064 issued Jan. 2, 1973. All of these references represent technology for inspecting dielectric members such as glass containers for deviations in the thickness of the walls of the glass. In all of these prior art devices, an inspection probe is very precisely positioned relative to its distance from the surface of the dielectric material or side wall of the glass container and is supported relative to the side wall of the container by a single roller, thus the probe is positioned relative to the bottle at a single point. The probe and roller are biased against the side wall of the rotating container. In this manner the spacing of the probe from the bottle is always constant throughout the measuring cycle.

The present invention, while utilizing the same type of high frequency probe, provides a system for mounting the probe and the positioning of the probe relative to the container such that the spacing of the probe from the container will change depending upon the roundness of the container or the deviations of the container wall from that of a right cylinder.

Accordingly, it is an object of this invention to provide an improved method and apparatus for inspecting glass containers for non-symmetricity.

It is a further object of this invention to provide an improved method and apparatus for inspecting dielectric members for out-of-round characteristics.

It is a still further object of this invention to segregate the bad or seriously irregular containers from the acceptable containers.

SUMMARY OF THE INVENTION

The method and apparatus for inspecting cylindrical articles formed of a dielectric material for out-of-round characteristics in which a radio frequency probe having a generally planar face is supported in proximity to the side wall of the article and rotating the article relative to the probe while permitting the probe to move toward or away from the side wall of the article as a predetermined arc of the side wall changes in curvature and indicating the probe output as a function of the "out-of-roundness" of the container wall.

DETAILED DESCRIPTION OF THE DRAWINGS

Figure 1:
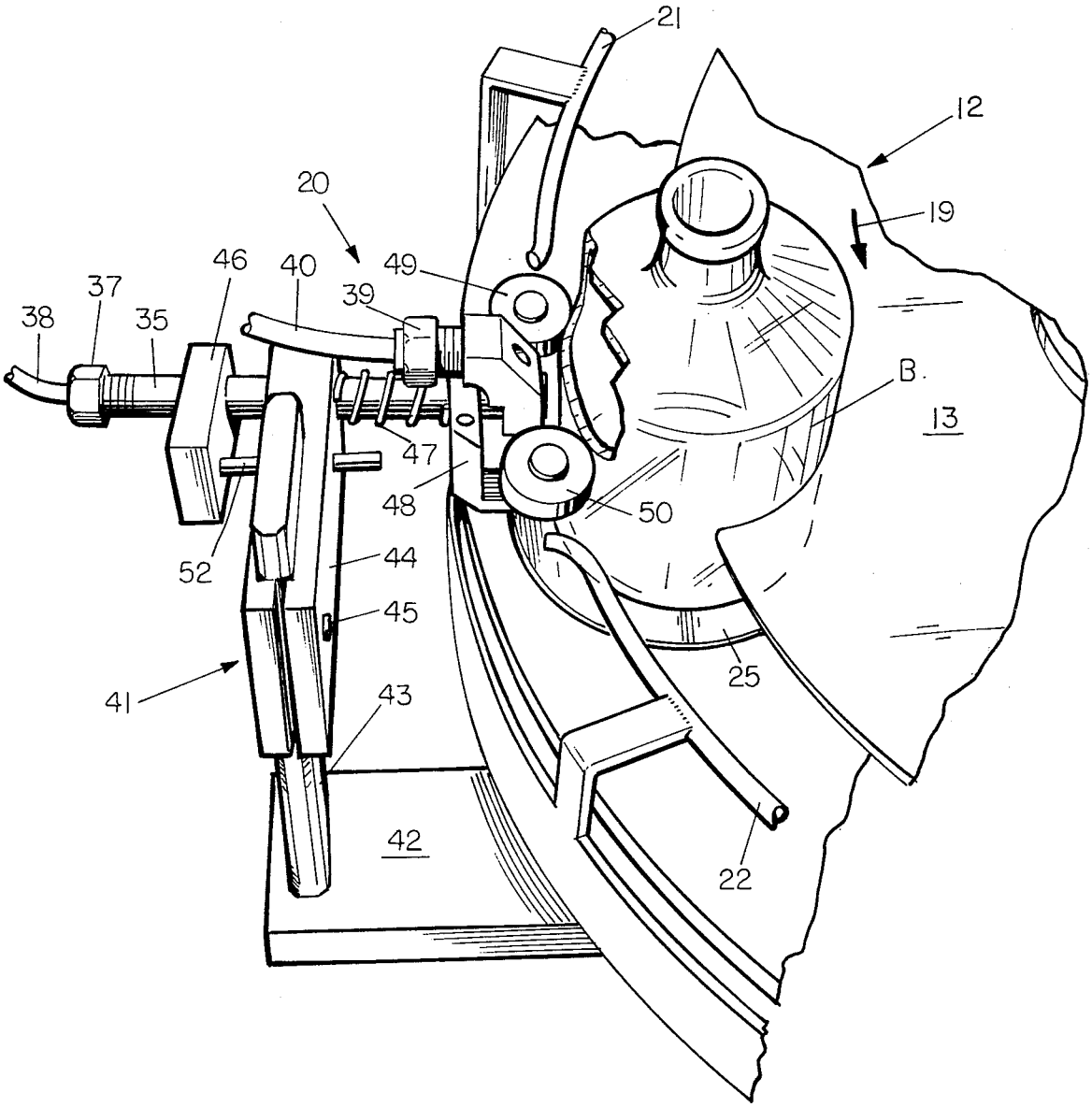
FIG. 1 is a perspective view of the apparatus of the invention shown in operative position relative to article handling equipment.

As illustrated in FIG. 1, a portion of a mechanism for handling and feeding bottles to an inspection position where the bottles are rotated is shown. The details of this mechanism are described in U.S. Pat. No. 3,379,306.

A carrier will individually position a container in front of an inspection device and while the container is so positioned, it is rotated about its vertical axis and the inspection head is held in close proximity to the side wall of the bottle at a selected vertical location thereof.

Variations in the proximity of the wall of the container being inspected to the probe will result in an electrical output voltage which is processed by the electrical system to indicate a bottle which is found to be outside the dimension tolerances for acceptable containers or operate a mechanism to automatically reject any such bottle.

With reference specifically to FIG. 1, the apparatus of the invention is suitably supported in the position illustrated adjacent bottles B to be inspected. In actual practice, the bottles or articles are conveyed to arrive in timed sequence onto a platform over which a pocketed carrier 12 will be rotated.

As best shown in FIG. 1, the carrier 12 takes the form of a "Micarta" disc 13. The Micarta disc 13 is driven by a shaft (not shown) fixed centrally thereof. The shaft is driven by a mechanism (not shown) which provides an indexing motion, it being understood that for the particular mechanism shown in FIG. 1, the carrier 12 will be indexed between each measuring interval in the manner taught in the above-referred-to U.S. Pat. No. 3,379,306.

The Micarta disc 13 is provided with slots or pockets 18 within which the lower, side wall portion of the bottles being gauged will fit. Thus it can be seen that upon rotation or indexing movement of the carrier 12 in the direction of the arrow 19 shown thereon, the bottles B will be carried in succession from an incoming position into the inspection position opposite an inspection head, generally designated 20.

The bottles are guided in their arcuate travel by a rail 21. A substantially identical rail 22 is provided on the exit side of the mechanism to effectively guide and hold the bottles within the pockets or slots 18. It should be understood that these rails 21 and 22 are of sufficient width so as to engage the sides of the bottles in such a manner as to prevent them from tipping during their arcuate movement from the incoming or entrance position to and through the inspection position.

As the bottle comes into the position shown in FIG. 1, the lower portion of the bottle will engage a spinner pad 25. The pad may be provided with a vacuum connection so as to, in effect, grip a bottle positioned thereon to avoid slippage during rotation. The pad 25 is rotated by a constant speed motor, and when the bottle arrives in engagement with the pad, the bottle will be rotated about its vertical axis.

In the foregoing manner the bottles are brought into the inspection position and rotated while retained with their axes substantially vertical during rotation by the driven pad 25.

With the bottle to be inspected located in the inspecting position, an inspection head 20 will be in engagement with the side wall of the bottle and effectively provide an arrangement for measuring the concentricity of the bottle side wall throughout the circumference of the bottle at the region opposite the inspection head.

It should be readily appreciated that the specific vertical location of the head is a matter of design preference and experience when inspecting bottles. Each particular design of a bottle usually has "problem areas". In the setting up of the present inspection device, it is desirable that the head be positioned opposite that portion of the wall of the containers which, through experience, has been found most likely to be the area where "out-of-roundness" may appear most pronounced.

As indicated, selection of the positioning of the head with respect to the particular container being gauged, is a matter of experience gleaned after many years of observing the operation of bottle forming machines and meticulous inspection of many formed bottles.

Figure 2:
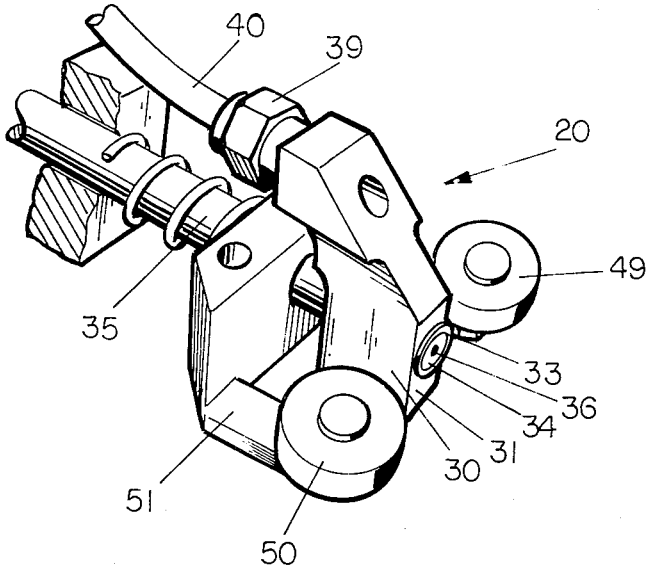
FIG. 2 is a perspective view of the inspection head of FIG. 1.

The inspection head 20 is shown in detail in FIG. 2 and basically takes the form of a light-weight metal block 30. The block 30 has a generally square front face 31. The front face 31 of block 30 is drilled out to provide a cavity within which a metal sleeve 33 is positioned. The sleeve 33 is supported within the cavity by an annular plastic sleeve. The metal sleeve serves as an electrical field producing antenna, with the plastic sleeve serving as a means for electrically insulating the metal sleeve 33 from the block 30. Block 30 is also provided with a horizontal opening coaxially located with respect to the cavity and extending from the front face throughout the length thereof. An insulating sleeve 34, formed of a non-conductive plastic material, is positioned within the metal sleeve 33, and extends rearwardly from the face 31 through a supporting shaft 35. The insulating sleeve 34 has a bore extending throughout its length within which is positioned a small conductor 36 in the form of a copper wire with one end exposed at the front face of the inspecting head 20. This small conductor 36 serves as the measuring or sensing probe. The probe wire or conductor 36 extends rearwardly through the insulating sleeve 34 within the supporting shaft 35 and at the rearward end of the shaft 35 there is provided a quick disconnect socket 37 with a cooperating plug-in lead 38 providing the electrical connection to the probe wire 36. As previously stated, the metal sleeve 33 forms a radio frequency antenna and is connected to a wire or lead (not shown) which extends through a passage formed in the block 30. The wire or lead is insulated from the block and at the rearward face of the block there is provided a connector 39 by which the wire or lead is connected to an insulated lead 40. The configuration of the head 20 is somewhat modified with respect to the inspection head shown in U.S. Pat. No. 3,393,799; however, electrically speaking, the head is similar.

With particular reference to FIG. 1, it can be seen that the inspection head 20 is supported adjacent the pockets or slots 18 in disc 13 by a stand generally designated 41. The stand takes the form of a horizontal platform 42 supporting a vertical post 43 which extends through a bifurcated arm 44. The arm may be adjusted vertically by loosening a retaining bolt 45 and moving the arm relative to the post 43. An opening is formed through the arm 44 through which the supporting shaft 35 extends. A clamp 46 fixed to the shaft 35 serves as the limiting member with regard to the forward extension of the supporting shaft 35. The clamp 46 also carries a pin 52 which extends through an opening in the arm 44. The pin 52 will assure that the shaft 35 will not rotate about its longitudinal axis. A spring 47 positioned between the arm 44 and a cross arm 48 maintains the inspection head in its extended position. As a bottle or container is moved into the inspection station, it is engaged by a pair of rollers 49 and 50, rotatably mounted on horizontally extending arms 51 which extend outwardly from the cross arm 48. It should be understood that the cross arm 48 is fixed to the supporting shaft 35 at a particular location, depending upon the diameter of the container being inspected, so that the probe will not be hit by the rotating container. Both of the rollers 49 and 50 are freely rotatable about vertical axes which are spaced apart from each other a specific distance so that when the rollers are in contact with the side wall of a bottle or container having a theoretically, perfectly cylindrical configuration, will provide an output signal of a constant or steady voltage.

Figure 3:
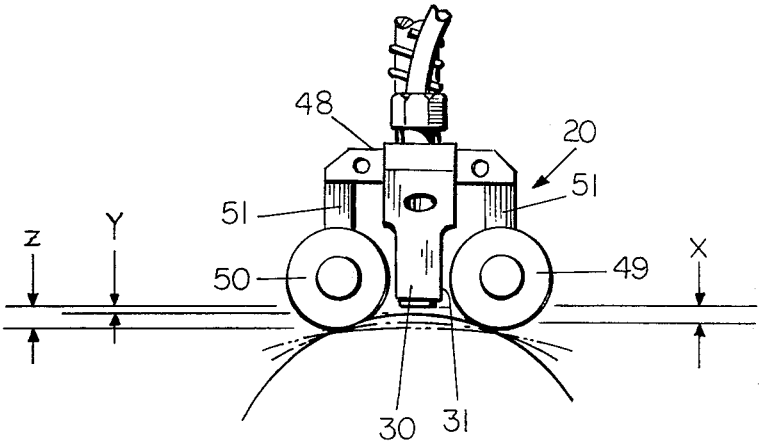
FIG. 3 is a schematic, top plan view of the inspection head and its relationship to two different container curvatures.

It should be understood that the position of the probe 36 relative to the postion of the side wall of the container will determine the level of the output of the probe. A perfectly cylindrical container of dielectric material will give a steady state output, since the probe will always be the same distance from the wall thereof. In the event the container has an out-of-round characteristic, or has a different radius of curvature from one part to another, the probe will move toward or away from the article side wall depending upon the spacing of the rollers 49 and 50 and the degree of curvature of the article. While the probe is also sensitive to some degree to the thickness of the dielectric material of the article, it has been applicant's experience that the probe is three to four times more sensitive to probe-to-glass distance than it is to actual glass thickness and thus the discrimination between acceptable bottles, thickness-wise, and "out-of-round" containers, is very easy to make. A typically out-of-round bottle will be egg-shaped or oval in cross section. Thus in one revolution the bottle's outer wall will excursion on two occasions closer to, and on two occasions farther away from, the optimum probe-to-glass distance position of the ideally round container. This is illustrated in FIG. 3 of the drawings in which a perfect container having a constant curvature matching the dot-dash line will track with a probe-to-glass distance of X while a container having a shorter radius in one direction and a longer radius at 90° with respect thereto, will exhibit an excursion between the distance Y and Z. In the actual operation of the present invention, the probe output will be, in effect, the sum of the glass thickness component and the probe-to-glass distance component. As previously mentioned, the distance component is the most influential component by a factor of 3 or 4.

Figure 4:
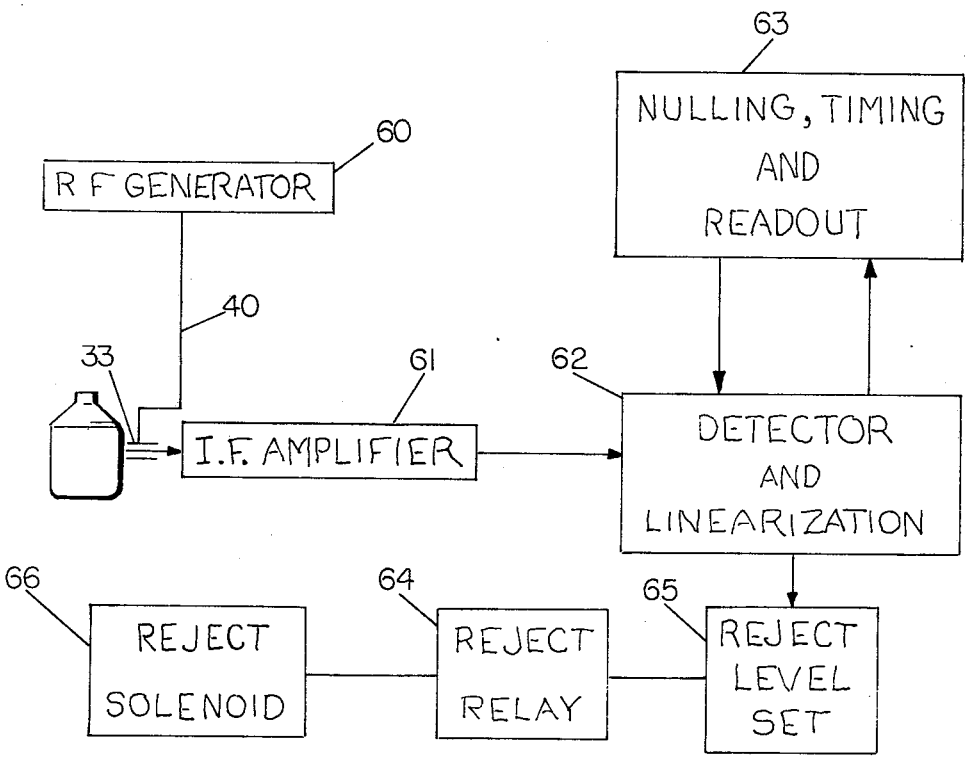
FIG. 4 is a schematic, electrical circuit diagram of the electronic system of the invention.

The electrical measuring system utilized in the present invention is illustrated in FIG. 4. A radio frequency generator 60 has its output connected to the antenna 33 through the shielded conductor 40. The voltage signal from the probe 36 is connected to an IF amplifier through the lead 38.

The output of the IF amplifier 61 is connected to a detector and linearization circuit 62. The detector and linearization circuit is connected, for control purposes, to the nulling, timing and readout 63 which insures that the gauging is carried out only when a container is in station and gauging is not done during indexing of the containers when a container is not in position opposite the probe. The detector output in turn is connected to a reject relay 64 through a reject level setting circuit 65, with the operation of the relay 62 controlling a reject solenoid 66 whose function or operation will control a reject motor in the same manner as more fully described in U.S. Pat. Nos. 3,708,064 and 3,379,306 referred to above.

The schematic circuit of FIG. 4 is composed of commercially available components for effecting the measurements desired.

Thus it can be seen that applicant has provided an apparatus which is sensitive to the out-of-round condition of a cylindrical dielectric article or object which is rotated about its axis so as to present the cylindrical wall thereof to a radio frequency probe which is permitted to move toward or away from the article side wall if a preselected arcuate distance of the side wall changes in curvature.

I claim:

1. A method of inspecting cylindrical articles formed of dielectric material for out-of-round characteristics, comprising the steps of:

supporting a radio frequency probe having a generally planar face in predetermined proximity to the side wall of said article;

rotating the article about its axis;

permitting said probe to move toward or away from said article wall as a preselected arcuate distance of said side wall changes in curvature; and indicating the output of said probe as a function of the out-of-roundness of said container wall passing said probe face.

2. The method of claim 1 further including the step of rejecting articles in which the distance of the probe from the wall exceeds predetermined limits.

3. In apparatus for measuring the out-of-round characteristics of a generally cylindrical container formed of dielectric material wherein:

a radio frequency probe having a generally planar face is connected to a radio frequency source;

with means for supporting the probe with its axis extending normal to the side wall of the container;

means for rotating the container about its central axis, the improvement in said means supporting said probe comprising means for holding said probe a known distance from the side wall of said container when the side wall has a given curvature through a given arcuate distance while permitting said probe to move closer to or farther away from said wall as the curvature changes in said given arcuate distance; and means connected to said probe for indicating the output of said probe as a function of the out-of-roundness of said container wall.

4. The apparatus of claim 3 further including reject means connected to said indicating means for rejecting containers having overly eccentric side walls.

5. Apparatus for measuring the out-of-round characteristics of a generally cylindrical article formed of dielectric material, comprising:

a radio frequency probe having a generally planar face;

means connecting said probe to a radio frequency source;

a generally U-shaped cradle; means for supporting the probe in the cradle, with the probe extending parallel to and intermediate the legs of said U-shaped cradle;

a roller rotatably mounted on the end of each leg of said U-shaped cradle;

means for rotating the cylindrical article in contact with said rollers; and means connected to said probe for indicating the output of said probe as a function of the out-of-roundness of said cylindrical article.

6. The apparatus of claim 5 further including means connected to the output of said probe for rejecting articles that exceed a permissible out-of-roundness.

7. The apparatus of claim 5 wherein said U-shaped cradle has legs that are separated by a distance no greater than one-sixth of the circumference of the article under test.

8. The apparatus of claim 5 wherein said U-shaped cradle has legs that are separated by a distance of at least 15° of the circumference of said article being inspected.

* * * * *